United States Patent [19]

Shapiro

[11] Patent Number: 4,817,860

[45] Date of Patent: Apr. 4, 1989

[54] FRAGRANCE RELEASING ENVELOPE

[76] Inventor: Ruth Shapiro, 8113 Ave. L, Brooklyn, N.Y. 11236

[21] Appl. No.: 16,933

[22] Filed: Feb. 20, 1987

[51] Int. Cl.[4] ..... B65D 27/16

[52] U.S. Cl. ..... 229/80; 206/632; 428/905; 493/260

[58] Field of Search ..... 229/68 R, 80; 428/905; 206/632; 493/260, 261, 264

[56] References Cited

U.S. PATENT DOCUMENTS

| | | | |
|---|---|---|---|
| 350,928 | 8/1886 | Homeniuk | 229/80 |
| 739,505 | 9/1903 | Peterson | 229/80 |
| 841,346 | 1/1907 | Sherman | 229/80 |
| 925,367 | 6/1909 | Mihaelson | 229/80 |
| 2,139,654 | 12/1938 | Berkowitz | 229/68 R |
| 2,215,989 | 9/1940 | Wolf | 229/80 |
| 2,251,391 | 8/1941 | Berkowitz | 229/80 |
| 2,367,440 | 1/1945 | Schiemen | 229/80 |
| 3,143,280 | 8/1964 | Hiersteiner | 206/632 |
| 3,489,332 | 1/1973 | Knittel | 229/80 |
| 3,599,859 | 8/1971 | Maierson | 206/611 |
| 3,692,233 | 9/1972 | Carter, Jr. | 229/80 |
| 3,693,869 | 9/1972 | Eaves, Jr. | 229/73 |
| 4,308,987 | 1/1982 | Solomon | 206/632 |
| 4,487,801 | 12/1984 | Turnbull et al. | 229/68 R |

FOREIGN PATENT DOCUMENTS

| | | | |
|---|---|---|---|
| 571266 | 2/1933 | Fed. Rep. of Germany | 229/80 |
| 355502 | 11/1905 | France | 229/73 |
| 468143 | 6/1937 | United Kingdom | 229/80 |
| 468074 | 6/1937 | United Kingdom | 229/80 |

*Primary Examiner*—Stephen P. Garbe

*Attorney, Agent, or Firm*—Natter & Natter

[57] ABSTRACT

A foldable envelope blank provides an envelope structure having a closure flap presealed with a temporary bond including microencapsulated fragrance dispersed within an adhesive matrix. The adhesive material is disposed on a coplanar surface on the envelope blank at discrete areas adapted for registered alignment during the fabrication procedure. The opening of the closure flap is effective for rupturing the microcapsules and releasing fragrance.

6 Claims, 2 Drawing Sheets

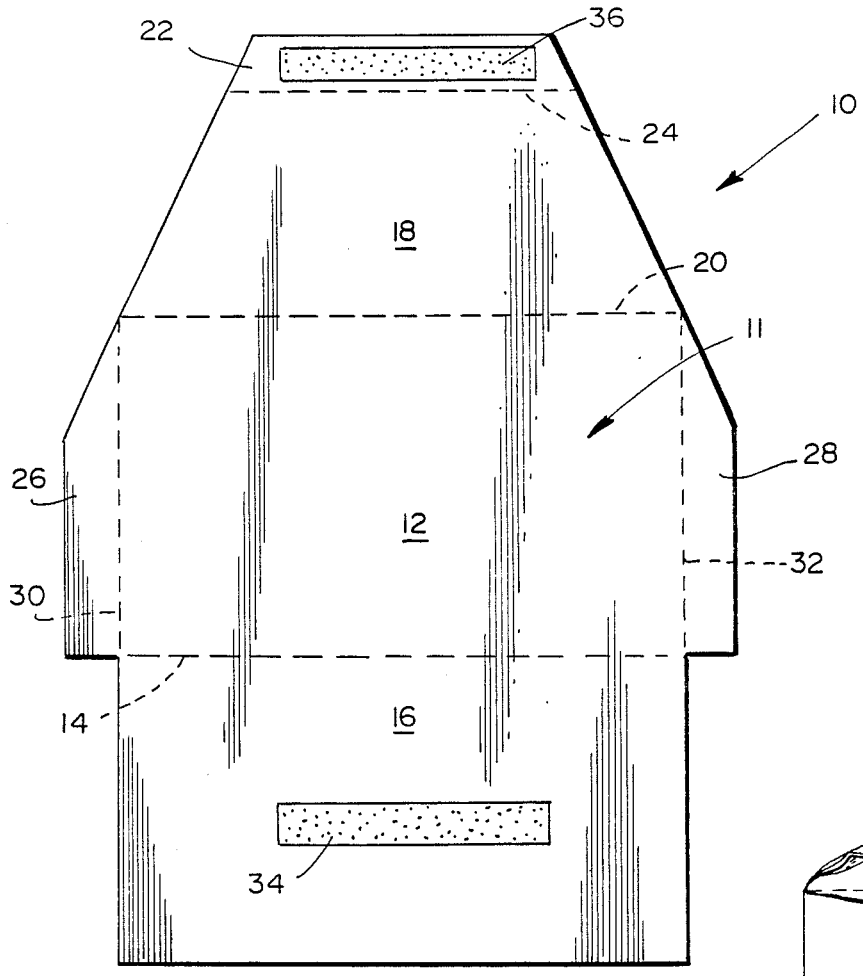
FIG. 1
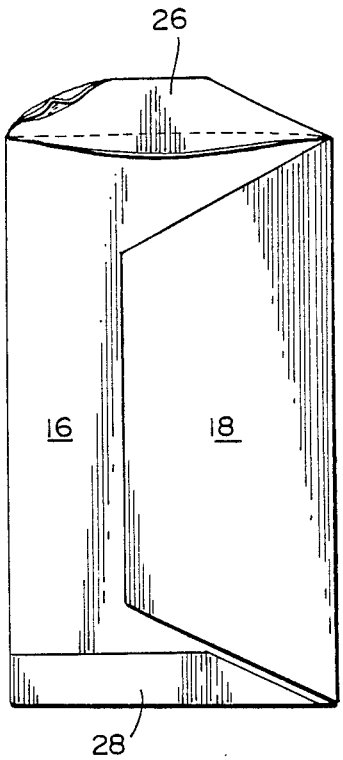
FIG. 3
FIG. 2
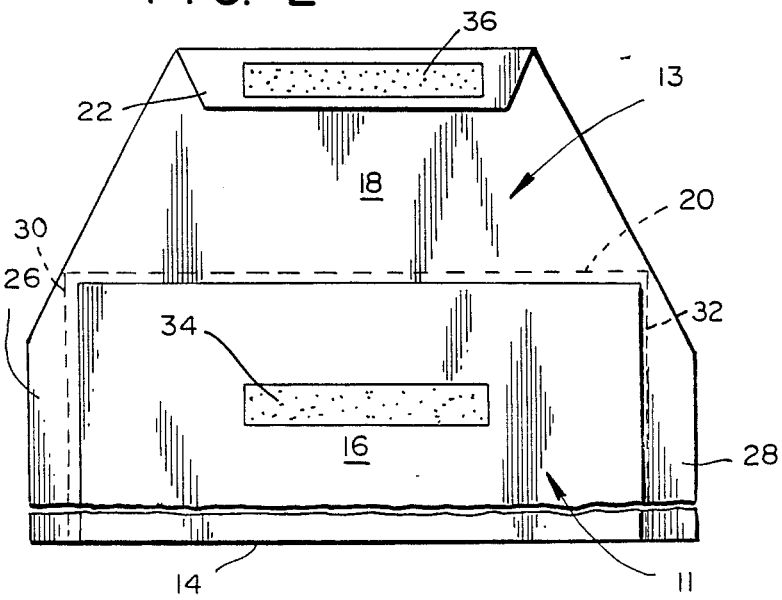

FRAGRANCE RELEASING ENVELOPE

BACKGROUND OF THE INVENTION

Field of the Invention

This invention relates to an envelope construction and method of manufacture and especially to an envelope having a presealed closure flap and a selectively sealable side flap for providing entry access into the envelope.

In particular, the envelope of this invention provides for the release of a fragrance upon lifting the closure flap from the body of the envelope as when removing the contents from the envelope.

Background Art

Enclosures, such as mailing envelopes were generally fabricated with interconnected front and back walls and included a sealing flap whereby the open pocket of the envelope was closed prior to mailing. The sealing flap was generally intended for permanent bonding after insertion of the contents and the opening thereof was achieved by use of a letter opener or similar instruments.

If it was desired to introduce a scent, this was accomplished by applying a fragrance such as perfume, to the contents. An obvious shortcoming of this procedure was that the strength and effectiveness of the fragrance could not be accurately controlled and frequently diminished between the mailing and receipt of the envelope.

Another technique for transmitting a fragrance sampling, especially for sales promotion, utilized a sealed foil or plastic packet containing a scent impregnated sheet of material which was enclosed within the envelope and was opened when the recipient removed the contents of the envelope. A problem inherent with this arrangement was that it required the active participation of the recipient. Furthermore, since it did not achieve a spontaneous release of the fragrance upon the opening of the envelope, it did not create an immediate impact upon the recipient.

The use of microcapsulated fragrances have been primarily directed to the promotion of perfumes by way of advertising inserts in magazines and within envelopes containing credit card billings. Those fragrance inserts included a folded piece of paper having a portion thereof temporarily bonded to an adhesive containing the microencapsulated fragrance being promoted. The use of a fragrance releasing pull-apart sheet was typically described in U.S. Pat. No. 4,487,801.

The application of this concept to envelopes was discussed in that patent with regard to a water-remoistenable adhesives. A disadvantage of microcapsules dispersed within a water-remoistenable adhesive is that there is no assurance that the user will apply the adequate moisture and pressure for effecting an appropriate and temporary bonding. Furthermore, prior to using the envelope, the microcapsules are exposed to the air and thus subject to absorption of moisture and/or damage from handling which could adversely affect the binding forces. In this regard it should be apparent that the adhesive strength of the binder should exceed the tensile rupture limits of the capsules.

It has been found that a scent or fragrance releasing envelope of the present invention, and the process of making same, overcomes those limitations, shortcomings and disadvantages.

Summary of the Invention

Briefly, the nature of this invention concerns an envelope having a presealed closure flap temporarily bonded by an adhesive layer containing rupturable fragrance microcapsules dispersed therein. The microcapsules are ruptured by peeling the closure flap from the body of the envelope thereby releasing the encapsulated ingredients. The envelope construction further includes a selectively sealable side flap for providing entry access.

An advantage of the envelope construction of this invention is that it does not rely upon a remoistenable adhesive.

Another aspect of this invention is that the adhesive containing microencapsules are coated on an envelope blank in discrete fragrance strips disposed on a coplanar surface which is compatible for mass production procedures.

In addition, the fragrance strips can be placed in registered alignment for adhesive bonding, and positioned off-set from the peripheral margin of the sheet so as to permit peelable separation.

Another feature of the envelope of this construction is that it utilizes a side flap for entry access.

Having thus summarized the invention, it will be seen that it is an object thereof to provide a fragrance releasing envelope of the general character described herein which is not subject to the aforementioned deficiencies.

Specifically, it is an object of this invention to provide a fragrance releasing envelope containing a microencapsulated fragrance.

A further object of this invention is to provide a fragrance releasing envelope having a closure flap incorporating a microencapsulated fragrance dispersed within an adhesive.

Another object of this invention is to provide a fragrance releasing envelope wherein the fragrance strip is applied and the closure flap is sealed under controlled conditions during manufacture.

Still another object of this invention is to provide a fragrance releasing envelope wherein the fragrance is applied to discrete coplanar surface of the envelope blank and the blank is foldable for registered alignment of the fragrance sur faces during the manufacturing process.

Still another object of this invention is to provide a fragrance releasing envelope of the general character described herein which simple in construction, low in cost, reliable in use, and well adapted for mass production.

Other objects of the invention will in part be apparent and will in part be pointed out hereinafter.

With these ends in view, the invention finds embodiment in certain combinations elements and arrangements of parts by which the aforementioned objects and certain other objects are hereinafter attained, all as more fully described with reference to the accompanying drawings and the scope of which is more particularly pointed out in the appended claims.

BRIEF DESCRIPTION OF DRAWINGS

In the accompany drawings in which are shown exemplary embodiments of the invention:

FIG. 1 is a plan view of an envelope blank of the present invention showing a plurality of fold lines dividing of the blank into a top panel, a front panel, a rear panel, and a pair of side flaps, and further illustrating a pair of registrable fragrance strips;

FIG. 2 is a view of a reverse side of the envelope blank of FIG. 1 shown with the rear panel folded upon the front panel and a closure flap folded upon the top panel;

FIG. 3 is a view of the reverse side of the envelope after the adhesive bonding of the top panel to the rear panel and the sealing of one said side flaps to the rear panel;

DETAILED DESCRIPTION OF THE INVENTION

Figure 4:
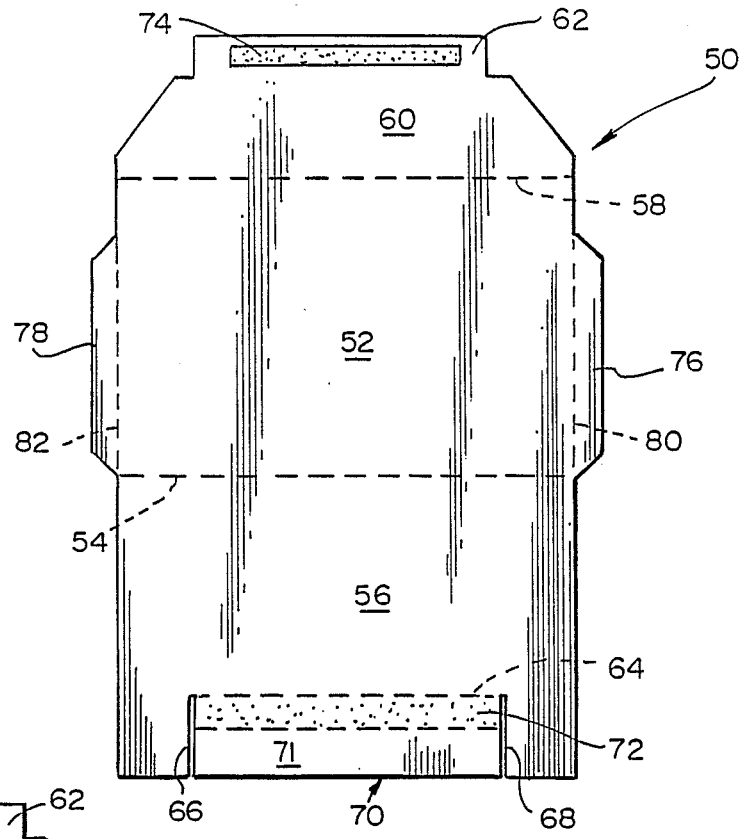
FIG. 4 is a plan view of an envelope blank of an alternate embodiment of the invention illustrating a plurality of fold lines defining a top panel, a front panel, a pair of side flaps, and a rear panel, said rear panel including a hinged closure flap.

Referring now to the drawings in detail, the reference numeral 10 denotes generally an envelope blank in accordance with this invention. The envelop blank 10 includes an outer planar surface 11 or obverse side. It should be obvious that an inner planar surface 13 or reverse side, has the same configuration.

The blank 10 includes a plurality of foldably connected panels and flaps, which when folded and sealed as described hereinafter, result in the envelope construction of the present invention.

The envelope blank 10 includes a front panel 12, foldably connected along a lower margin by a first transverse fold line 14, to a rear panel 16. The front panel 12 is also connected along an upper margin by a second transverse fold line 20, to a top panel 18. The top panel 18 has a trapezoidal configuration and defines a closure flap 22 foldably connected to the top panel 18 along a fold line 24. The front panel 12 and the rear panel 16 are rectangular in shape.

Extending from the opposite sides of the front panel 12 are a first and a second side flap 26, 28 respectively. The side flaps 26, 28 are foldably connected to the front panel by a longitudinal fold line 30, 32 respectively.

An adhesive matrix having fragrance containing micro capsules dispersed therein is applied to the rear panel 16 in a discrete strip 34 and similarly to the closure flap 22 by a discrete strip 36. It should be noted that the fragrance strips 34, 36 are placed for registered alignment when the envelope blank has been folded in accordance with the invention. Furthermore, the microencapsulated fragrance strips 34, 36 can be surface coated unto the envelope blank 10 at predetermined locations or intervals on a continuous web of envelope stock prior to cutting the envelope blanks. Additionally, it should be observed that the adhesive can be applied other than as in a strip and the procedure for applying the adhesive is not limited to coating.

By way of example the compositions of the microcapsules can be urea-formaldehyde resin, a melamine formaldehyde resin, or the polycondensation products of monomeric or low molecular weight polymers of dimethylolurea or methylolated urea with aldehydes.

Further, in accordance with the invention it should be noted that the fragrance strips 34, 36 are spaced from the peripheral margin of the rear panel 16 and the closure flap 22 so as to facilitate the peelable separation of the fragrance strips 34, 36 after they have been bonded together.

Since the sealing of the envelope is performed during the production to insure quality control, rather by the end user, the adhesive is applied and bonded under controlled conditions for achieving appropriate bonding.

Subsequent to the application of the fragrance strips 34, 36, the next step to the procedure is to fold the rear panel 16 about the fold line 14 and the closure flap 22 about the fold line 24 such that the inner planar surface 13 lies in confronting relationship as shown in FIG. 2. The rear panel 16 now overlies the front panel 12 and the closure flap 22 overlies the top panel 18 with the fragrance strips 34, 36 being exposed. It should be noted at this point that the fragrance strips 34, 36 can alternately be applied at this stage of the fabrication process. This will be dependent upon the composition of the adhesive material selected and the time frame within which the adhesive bonding must be achieved. In either event however, it should be noted that the adhesive will be applied to discrete surface areas which are coplanar.

The next stage of the fabrication process includes the sealing of the side flap 28 to the rear panel 16 as is illustrated in FIG. 3. It should be apparent that the side flap 26 may be sealed instead of the side flap 28.

The procedure further provides for the securing of the closure flap 22 to the rear panel 16 wherein the fragrance strips 34, 36 are in registered alignment. This is achieved by folding the top panel 18 about the fold line 20.

As noted, the remaining side flap 26 is left open to provide access to the envelope pocket thus formed and can be sealed by use of a remoistenable adhesive.

In use, the envelope is opened by peelably lifting the closure flap 22 which will result in a rupture of the adhering microcapsules and the release of the contained fragrance. As previously mentioned, the fragrance strips 34, 36 are arranged so that they will be spaced from the peripheral edges of the closure flap 22 to facilitate separation. Furthermore, directions can be placed on the envelope, for instructing the recipient as to the proper manner of opening the envelope so that the microcapsules will be ruptured and the fragrance released.

Figure 5:
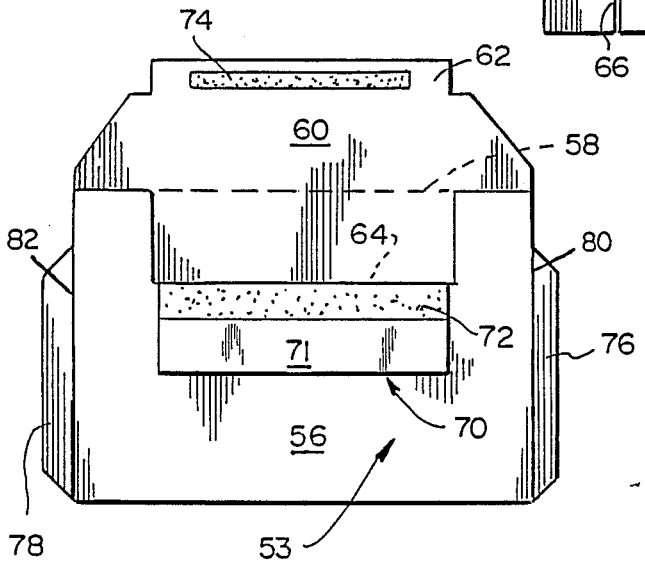
FIG. 5 is a view of the envelope blank of FIG. 4 showing the rear panel folded about the front panel and the hinged closure flap folded about the rear panel, and also detailing a fragrance strip on the closure flap and corresponding strip of an edge portion of the top panel.
Figure 6:
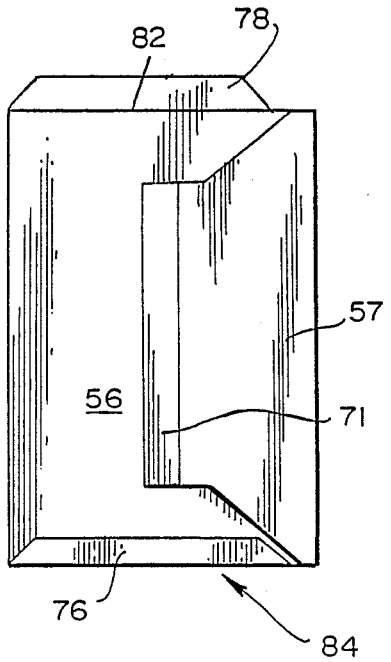
FIG. 6 is a front view of the envelope of FIG. 5 showing the fragrance strips adhesively bonded and one of the side flaps sealed to the rear panel.

In a variant form of the invention shown FIGS. 4–6, an alternate construction is shown for providing a closure arrangement. In this modified embodiment, an envelope 50, includes a front panel 52, a rear panel 56, and a top panel 60. The front panel 52 is foldably connected along a lower margin about a first transverse fold line 54, to the rear panel 56. The front panel 52 is also connected along a second transverse line 58, to the top panel 60. The top panel 60 includes an edge extension 62 which is generally rectangular in configuration as shown in FIG. 4.

Referring once again to the rear panel 56, a third transverse fold line 64 and a pair of longitudinal cut lines 66, 68 define a hinged closure flap 70. A fragrance strip 72, similar to the fragrance strip of the previous embodiment, is applied to a portion of the hinged closure flap 70 as shown in FIG. 4. It should be noted that a segment of the closure flap 70 is left free of the adhesive material to provide a peel tab 71. Similarly, a fragrance strip 74 is applied to the edge portion 62 and is off-set from the margin of the edge portion 62. Both the fragrance strips 72, 74 are adapted for registered alignment when the envelope blank is folded.

A pair of first and second side flaps 76, 78, respectively, are foldably connected to the front panel 52 by a pair of longitudinal fold lines 80, 82 respectively.

The fabrication procedure includes the folding of the rear panel 56 about the fold line 54 to overlie the front panel 52. The hinged closure flap 70 is folded, in an opposite direction, about the fold line 64 to assume the position shown in FIG. 5.

It should again be noted at this point that the fragrance strips 72, 74 can be applied at this stage of the folding operation or prior thereto, and will be dependent in part upon the adhesive substance and the time requirements for bonding.

The next stage of the fabrication operation includes folding the top panel 60, about the fold line 58 and achieving the adhesive engagement between the fragrance strips 72, 74.

The side flap 76 is next sealed to the rear panel 56 and preferably the confronting faces of the closure flap 70 and the rear flap 56 are secured together.

The side flap is 78 is left open to provide ingress to interior of the envelope and is then sealable.

In use, the edge extension 62, can be separated from the closure flap 70 to achieve rupture of the microcapsules.

Thus, it will be seen that there is provided a fragrance releasing envelope which achieves the various objects of the invention and which is well adapted to meet conditions of practical use.

Since various possible embodiments might be made of the present invention and various changes might be made in the exemplary embodiments set forth, it is to be understood that all materials set forth were shown and described in the accompanying drawings is to be interpreted as illustrative and not limiting sense.

Having thus described the invention, there is claimed as new and desired to be secured by Letters Patents:

1. An envelope adapted for releasing a fragrance upon opening thereof comprising:

an envelope blank;

said envelope blank defining a front panel;

a rear panel connected to the front panel along a first transverse fold line;

said rear panel being foldably displaceable about the first transverse fold line in overlying relationship with respect to the front panel;

a top panel connected to the front panel along a second transverse fold line;

said top panel being foldably displaceable about the second transverse fold line in overlying relationship with respect to the rear panel;

a closure flap for providing exit access to the envelope, said closure flap being defined by either of said top panel or said rear panel, said closure flap further being adapted for foldable displacement about a third transverse fold line;

said front panel having two side flaps, each of said side flaps being foldable about a respective longitudinal fold line; said side flaps further including sealing means for securing the flaps with one of said side flaps being secured to the rear panel and the other of said side flaps being selectively securable for providing entry access into the envelope;

at least two fragrance strips applied to a surface of the envelope blank;

said fragrance strips including an adhesive matrix containing fragrance within rupturable microencapsules;

said adhesive matrix providing a temporary bond between contiguous fragrance strips and having an adhesive strength which exceeds the tensile rupture limits of the microcapsules;

a first fragrance strip applied to said closure flap, said closure flap being displaceable about the third transverse fold line for positioning the first fragrance strip in confronting registration with a second fragrance strip for sealing engagement;

said closure flap being openable for removing the envelope contents upon separation of the fragrance strips with concomitant rupturing of the microcapsules and release of the fragrance.

2. An envelope adapted for releasing a fragrance upon opening as claimed in claim 1 wherein the adhesive matrix is spaced from the peripheral margin of the closure flap to define a tab for initiating a peelable separation of the fragrance strips.

3. An envelope adapted for releasing a fragrance upon opening as claimed in claim 1 wherein the closure flap is defined within the top panel.

4. An envelope adapted for releasing a fragrance upon opening as claimed in claim 1 wherein the closure flap is defined within the rear panel.

5. A method for manufacturing a fragrance envelope including the steps of:

(a) segmenting an envelope blank with transverse fold lines to define a top panel, a front panel, a rear panel and a closure flap;

(b) defining side panels at opposite edges of the front panel;

(c) applying an adhesive matrix containing microencapsulated fragrance to at least two discrete surface areas on the envelope blank, one of said areas lying on said closure flap;

(d) folding the rear panel along one of said transverse fold lines in confronting relationship with the front panel;

(e) folding the closure flap about a second transverse fold line for registering the surface areas containing the adhesive matrix;

(f) folding the top panel along a third transverse fold line;

(g) engaging the respective surface areas containing the adhesive matrix for providing a temporary bond; and (h) folding one of said side flaps in sealing engagement with the rear panel.

6. A method for manufacturing a fragrance envelope as in claim 5 including the step of selectively sealing the other side flap.

* * * * *